US011345524B2

(12) United States Patent
Ni

(10) Patent No.: US 11,345,524 B2
(45) Date of Patent: May 31, 2022

(54) BEVERAGE CONTAINER WITH HANDLE ACTUATION ARRANGEMENT

(71) Applicant: Zhenming Ni, San Marino, CA (US)

(72) Inventor: Zhenming Ni, San Marino, CA (US)

( * ) Notice: Subject to any disclaimer, the term of this patent is extended or adjusted under 35 U.S.C. 154(b) by 213 days.

(21) Appl. No.: 16/867,965

(22) Filed: May 6, 2020

(65) Prior Publication Data

US 2021/0347535 A1 Nov. 11, 2021

(51) Int. Cl.
*B65D 47/06* (2006.01)
*B65D 51/24* (2006.01)
*B65D 43/02* (2006.01)

(52) U.S. Cl.
CPC ..... *B65D 47/066* (2013.01); *B65D 43/0231* (2013.01); *B65D 51/242* (2013.01)

(58) Field of Classification Search
CPC ..... B65D 2251/1016; B65D 47/065; B65D 47/0871; B65D 25/46; B65D 47/066; A47G 19/2266; A47G 19/2272
USPC ..... 222/153.14, 482
See application file for complete search history.

(56) References Cited

U.S. PATENT DOCUMENTS 8,602,238 B2 * 12/2013 El-Saden ..... B65D 47/065 215/389
2017/0144809 A1 * 5/2017 Sorensen ..... B65D 43/26
2018/0192800 A1 * 7/2018 Coon ..... B65D 25/46
2019/0183269 A1 * 6/2019 Kalisz ..... B65D 47/065

* cited by examiner

*Primary Examiner* — Vishal Pancholi
*Assistant Examiner* — Robert K Nichols, II
(74) *Attorney, Agent, or Firm* — Tsz Lung Yeung

(57) ABSTRACT

A beverage container includes a container body and a lid. The lid includes a lid body having a receiving slot, and a handle actuation arrangement. The handle actuation arrangement includes a locking latch movably mounted in the receiving slot, a mouth piece, and an actuating handle. The mouth piece is pivotally connected to the lid body to move between a locked position and a extended position, The actuating handle includes an engaging member pivotally received in the receiving slot to engage with the mouth piece, and a handle member extended from the engaging member in such a manner that when the handle is pivotally moved with respect to the lid body, the engaging member is also driven to pivotally move to drive the mouth piece to disengage from the locking latch so as to allow the mouth piece to move from the locked position to the extended position.

22 Claims, 9 Drawing Sheets

BEVERAGE CONTAINER WITH HANDLE ACTUATION ARRANGEMENT

BACKGROUND OF THE PRESENT INVENTION

Field of Invention

The present invention relates a beverage container, and more particularly to a beverage container comprising a handle actuation arrangement, in which a handle is utilized to actuate an extension of a mouth piece for allowing a user to drink beverage.

Description of Related Arts

A conventional container, such as a beverage container for containing water, usually comprises a container body and a lid detachably attached on the container body. The lid usually comprises a lid body and a handle piece movably mounted on the lid body for allowing a user to grab on the handle piece and carry the beverage container.

Conventionally, the mouth piece is normally received and protected in the lid body so as to keep the mouth piece clean. When a user wishes to drink the liquid contained in the beverage container, he or she may need to push a button provided on the lid body for releasing the mouth piece and the mouth piece may be retained in a substantially upright position. Some sorts of handle may also be provided on the lid body for allowing the user to carry the beverage container.

A major disadvantage of the conventional beverage container as mentioned above is that the user must use one hand to hold the beverage container and at the same time use another hand to press the button for releasing the mouth piece. This is very inconvenient on the part of the user, especially when the user is exercising where using both hands is not feasible, such as when the user is riding a bike.

Therefore, there is a need to develop a beverage container having a lid which may allow a user to release a mouth piece and hold the beverage container more easily and conveniently.

SUMMARY OF THE PRESENT INVENTION

Certain variations of the present invention provide a beverage container comprising a handle actuation arrangement, in which a handle is utilized to actuate an extension of a mouth piece for allowing a user to drink beverage contained in the beverage container.

Certain variations of the present invention provide a beverage container comprising a handle actuation arrangement, in which a handle is utilized to actuate an extension of a mouth piece so that a user may use one hand to hold the beverage container and use other body parts, such as his chin to actuate release of the mouth piece.

In one aspect of the present invention, it provides a beverage container, comprising:

a container body having a container cavity; and a lid, which comprises a lid body detachably attached on the container body to selectively enclose the container cavity, the lid body having a receiving slot and an access opening communicating the container cavity and the receiving slot; and a handle actuation arrangement, which comprises:

a locking latch movably mounted in the receiving slot;

a mouth piece having a liquid discharge opening and a drinking channel communicating between the access opening and the liquid discharge opening, the mouth piece being pivotally connected to the lid body in the receiving slot to move in a locked position and a extended position, wherein in the locked position, the mouth piece is pivotally moved to receive in the receiving slot and engaged with the locking latch, wherein in the extended position, the mouth piece is pivotally moved to extend from the receiving slot; and an actuating handle, which comprises:

an engaging member pivotally received in the receiving slot to engage with the mouth piece; and a handle extended from the engaging member in such a manner that when the handle is pivotally moved with respect to the lid body, the engaging member is also driven to pivotally move to drive the mouth piece to disengage from the locking latch so as to allow the mouth piece to move from the locked position to the extended position.

In another aspect of the present invention, it provides lid for a beverage container, comprising a container body having a container cavity, the lid comprising:

a lid body arranged for detachably attaching on the container body to selectively enclose the container cavity, the lid body having a receiving slot and an access opening communicating the container cavity and the receiving slot; and a handle actuation arrangement, which comprises:

a locking latch movably mounted in the receiving slot;

a mouth piece having a liquid discharge opening and a drinking channel communicating between the access opening and the liquid discharge opening, the mouth piece being pivotally connected to the lid body in the receiving slot to move in a locked position and a extended position, wherein in the locked position, the mouth piece is pivotally moved to receive in the receiving slot and engaged with the locking latch, wherein in the extended position, the mouth piece is pivotally moved to extend from the receiving slot; and an actuating handle, which comprises:

an engaging member pivotally received in the receiving slot to engage with the mouth piece; and a handle extended from the engaging member in such a manner that when the handle is pivotally moved with respect to the lid body, the engaging member is also driven to pivotally move to drive the mouth piece to disengage from the locking latch so as to allow the mouth piece to move from the locked position to the extended position.

This summary presented above is provided merely to introduce certain concepts and not to identify any key or essential features of the claimed subject matter.

DETAILED DESCRIPTION OF THE PREFERRED EMBODIMENT

Figure 1:
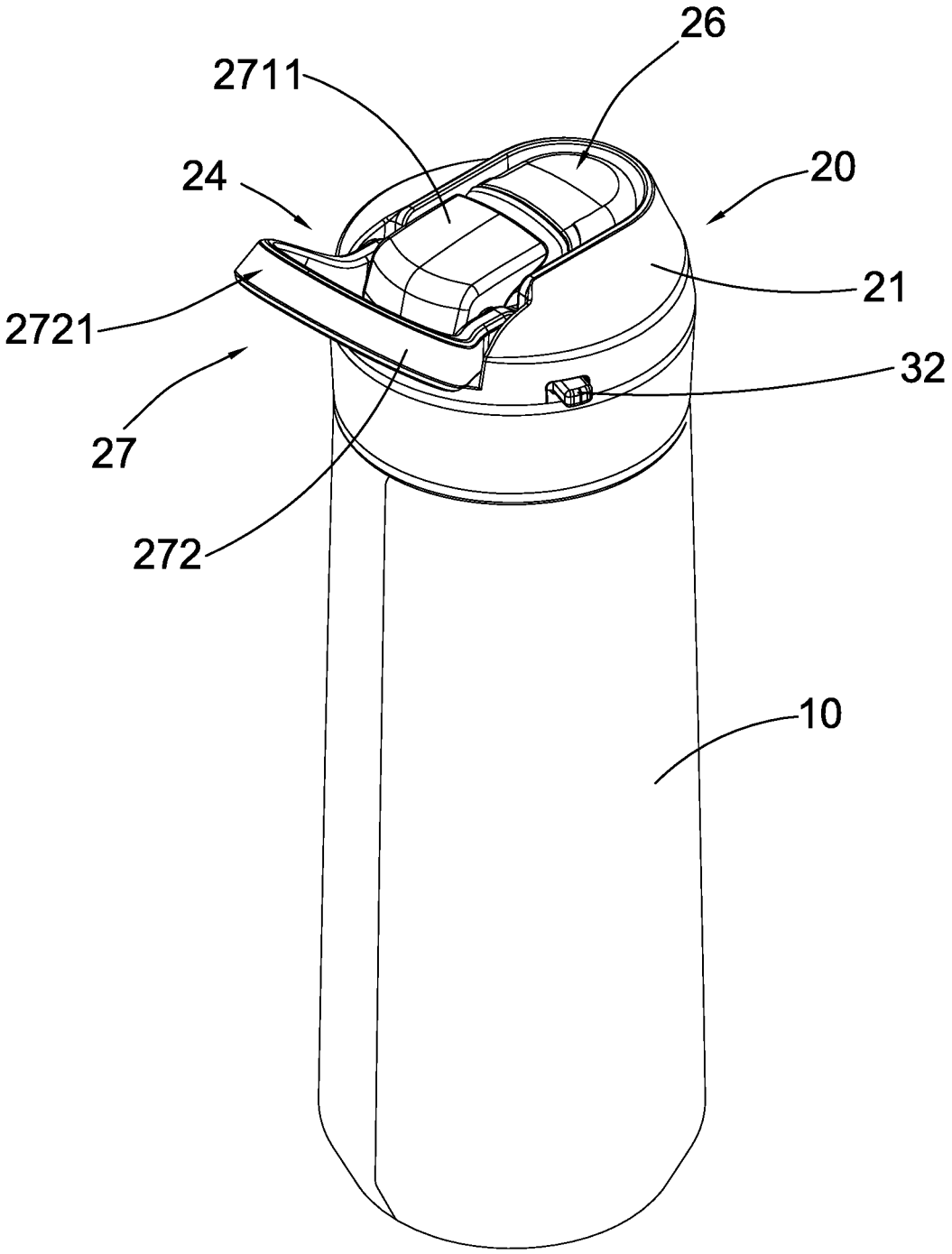
FIG. 1 is a perspective view of a beverage container according to a preferred embodiment of the present invention.

The following detailed description of the preferred embodiment is the preferred mode of carrying out the invention. The description is not to be taken in any limiting sense. It is presented for the purpose of illustrating the general principles of the present invention.

In the following descriptions, it should also be appreciated that the terms "arrange" and "set" in the following description refer to the connecting relationship in the accompanying drawings for easy understanding of the present invention. For example, the "arrange" and "set" can refer to one element directly or indirectly set or arrange on another element. Therefore, the above terms should not be an actual connection limitation of the elements of the present invention.

It should also be appreciated that the terms "center", "length", "width", "thickness", "top", "bottom", "front", "rear", "left", "right", vertical", "horizontal", "upper", "lower", "interior", and "exterior" in the following description refer to the orientation or positioning relationship in the accompanying drawings for easy understanding of the present invention without limiting the actual location or orientation of the present invention. Therefore, the above terms should not be an actual location limitation of the elements of the present invention.

Moreover, it should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of the present invention.

It should be appreciated that the terms "install", "connect", "couple", and "mount" in the following description refer to the connecting relationship in the accompanying drawings for easy understanding of the present invention. For example, the connection can refer to permanent connection or detachable connection. Therefore, the above terms should not be an actual connection limitation of the elements of the present invention.

Referring to FIG. 1 to FIG. 7, FIG. 8A to FIG. 8B, FIG. 9, FIG. 10A and FIG. 10B of the drawings, a beverage container according to a preferred embodiment of the present invention is illustrated. The beverage container may comprise a container body 10 having a container cavity 11, and a lid 20. The beverage container may be used for storing a predetermined amount of liquid, such as water, and may be carried in a portable manner.

The lid 20 may comprise a lid body 21 and a handle actuation arrangement 24. The lid body 21 may be detachably attached on the container body 10 to selectively enclose the container cavity 11. The lid body 21 may have a receiving slot 22 and an access opening 23 communicating the container cavity 11 and the receiving slot 22.

The handle actuation arrangement 24 may comprise a locking latch 25, a mouth piece 26, and an actuating handle 27. The locking latch 25 may be movably mounted in the receiving slot 22 of the lid body 21.

The mouth piece 26 may have a liquid discharge opening 261 and a drinking channel 262 communicating between the access opening 23 and the liquid discharge opening 261. The mouth piece 26 may be pivotally connected to the lid body 21 in the receiving slot 22 to move in a locked position and an extended position, wherein in the locked position, the mouth piece 26 may be pivotally moved to receive in the receiving slot 22 and engaged with the locking latch 25, wherein in the extended position, the mouth piece 26 may be pivotally moved to extend from the receiving slot 22 for allowing a user to drink the liquid through the mouth piece 26.

The actuating handle 27 may comprise an engaging member 271 and a handle member 272. The engaging member 271 may be pivotally received in the receiving slot 22 to engage with the mouth piece 26.

The handle member 272 may extend from the engaging member 271 in such a manner that when the handle member 272 is pivotally moved with respect to the lid body 21, the engaging member 271 may also be driven to pivotally move to drive the mouth piece 26 to disengage from the locking latch 25 so as to allow the mouth piece 26 to move from the locked position to the extended position.

According to the preferred embodiment of the present invention, the container body 10 may have a top opening 12 communicating with the container cavity 11. A predetermined amount of liquid may be stored in the container cavity 11. The container body 10 may be configured from plastic or metallic material, and may have thermal insulation structures.

The lid 20 may be detachably attached on the container body 10 to selectively enclose the container cavity 11. The lid 20 may further comprise a supporting platform 28 provided in the lid body 21 to divide the lid body 21 into an upper enclosure portion 211 and a lower tubular portion 212. As the name implies, the lower tubular portion 212 may form a tubular structure and may have a circumferential wall 2121 defining a central cavity 2122 as a space surrounded by the circumferential wall 2121. An inner surface 2123 of the circumferential wall 2121 may be threaded for threadedly connecting to the container body 10. Accordingly, the container body 10 may also have a threaded portion 13 for selectively engaging with the threaded inner surface 2123 of circumferential wall 2121.

Figure 4:
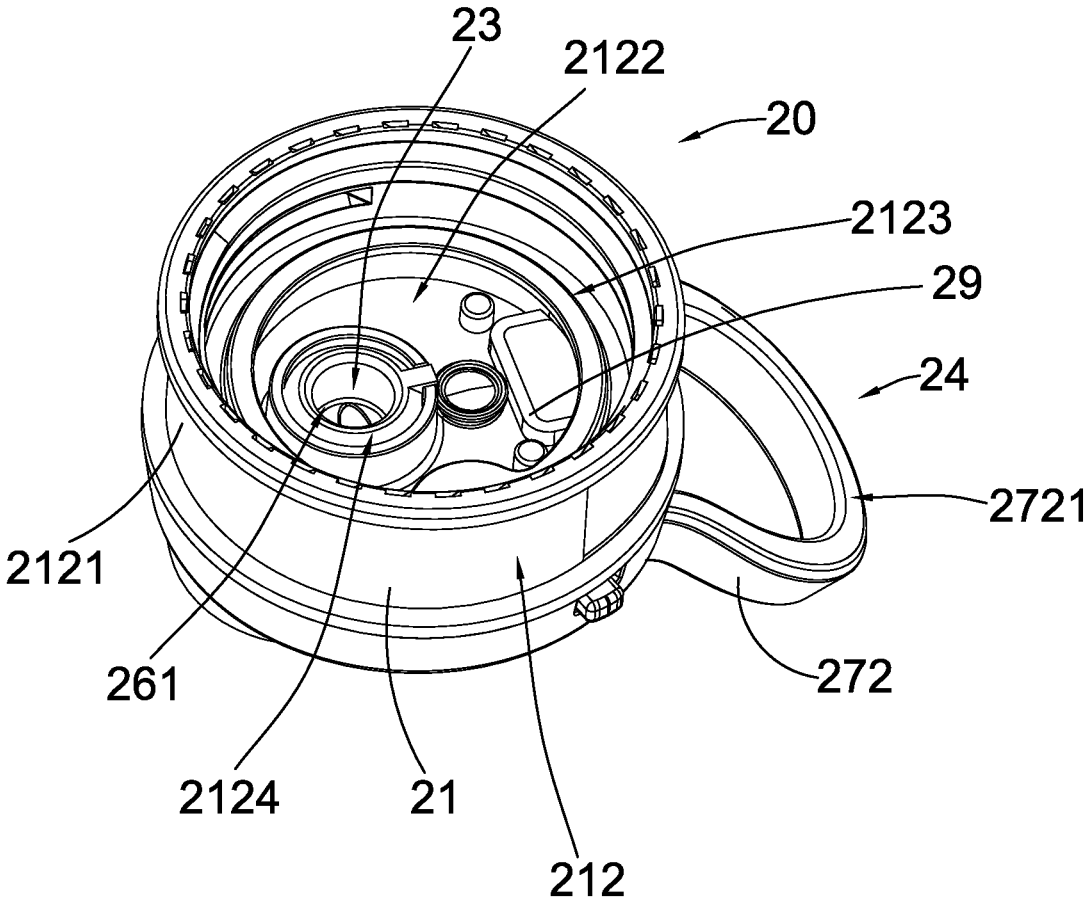
FIG. 4 is a bottom perspective view of the lid of the beverage container according to the above preferred embodiment of the present invention.

As shown in FIG. 4 of the drawings, the drinking channel 262 of the mouth piece 26 may communicate with the central cavity 2122 of the lid body 21 through a passage opening 2124 so that liquid stored in the container cavity 11 may pass through the passage opening 2124, the drinking channel 262 and liquid discharge opening 261 when the mouth piece 26 is in the extended position.

Figure 2:
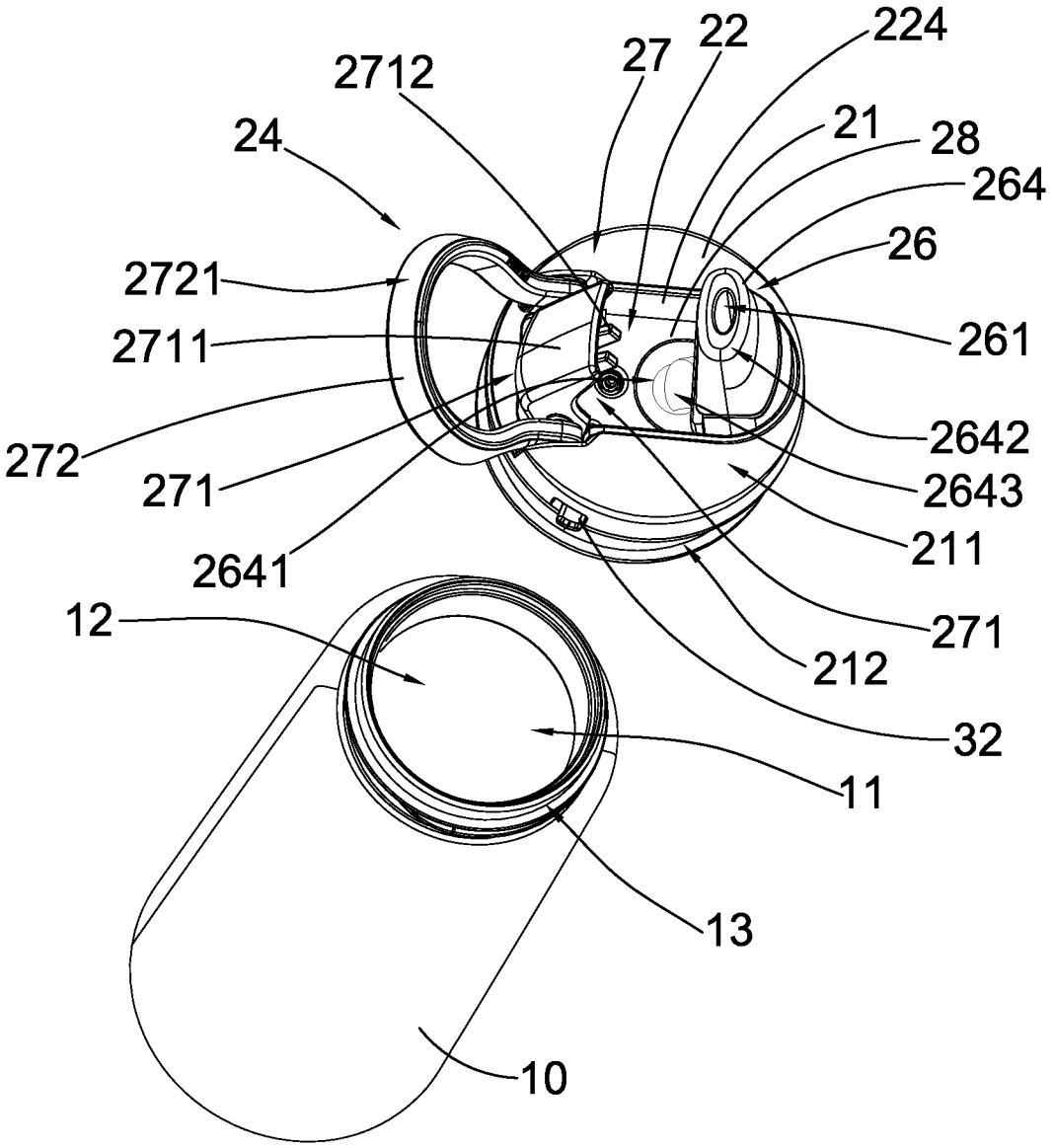
FIG. 2 is an exploded perspective view of the beverage container according to the above preferred embodiment of the present invention, illustrating that a lid is detached from a container body and a mouth piece is in an extended position.
Figure 8A:
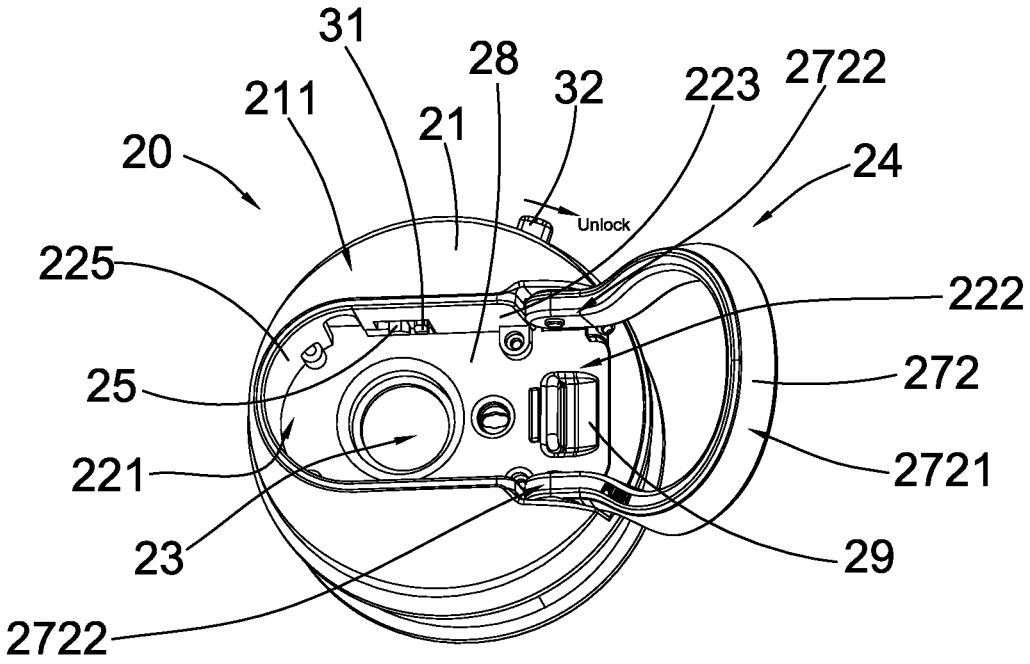
FIG. 8A and FIG. 8B illustrate the interaction between a blocking member and an actuation button of a locking arrangement of the lid of the beverage container according to the preferred embodiment of the present invention.
Figure 8B:
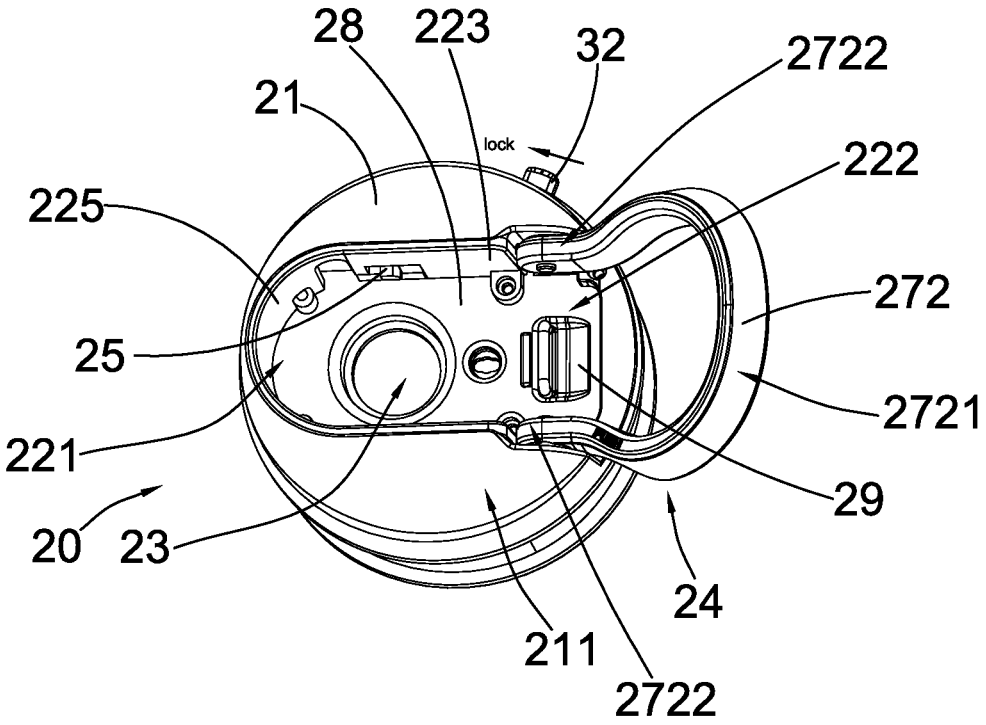

The upper enclosure portion 211 of the lid body 21 may be upwardly extended from the lower tubular portion 212 as separated by the supporting platform 28. The receiving slot 22 may be indently provided on the upper enclosure portion 211. As shown in FIG. 2 and FIG. 8A to FIG. 8B of the drawings, the receiving slot 22 may have a closed end portion 221 and an opposed opened end portion 222, wherein the mouth piece 26 may be operatively provided at the closed end portion 221 of the receiving slot 22, while the actuating handle 27 may be provided at the opened end portion 222. Thus, the receiving slot 22 may be defined as a space surrounded by a first sidewall 223, a second sidewall 224, a front wall 225 extending between the first sidewall 223 and the second sidewall 224 and a bottom wall 226 extending from the first sidewall 223, the second sidewall 224 and the front wall 225.

The locking latch 25 may be movably mounted on the first sidewall 223 in such a manner that the locking latch 25 may extend in the receiving slot 22. The handle actuation arrangement 24 may further comprise a first resilient element 241 mounted in the lid body 21 and may be arranged to normally exert a biasing force against the locking latch 25 so as to retain the locking latch 25 at a predetermined blocking position in the receiving slot 22. This blocking position of the locking latch 25 may be arranged to block a movement of the mouth piece 26.

Specifically, the mouth piece 26 may further comprise a mouth piece body 263, a suction member 264 coupled to the mouth piece body 263, and a biasing member 265 extended from the mouth piece body 263 to selectively engage with the locking latch 25. The mouth piece body 263 may be pivotally mounted to the first sidewall 223 and the second sidewall 224 so as to allow the mouth piece 26 as a whole to move between the locked position and the extended position as mentioned above. On the other hand, the suction member 264 may be made of elastic material, such as plastic material or silicon rubber, wherein a user is arranged to suck on the suction member 264 for drinking the liquid contained in the container cavity 11.

Figure 6:
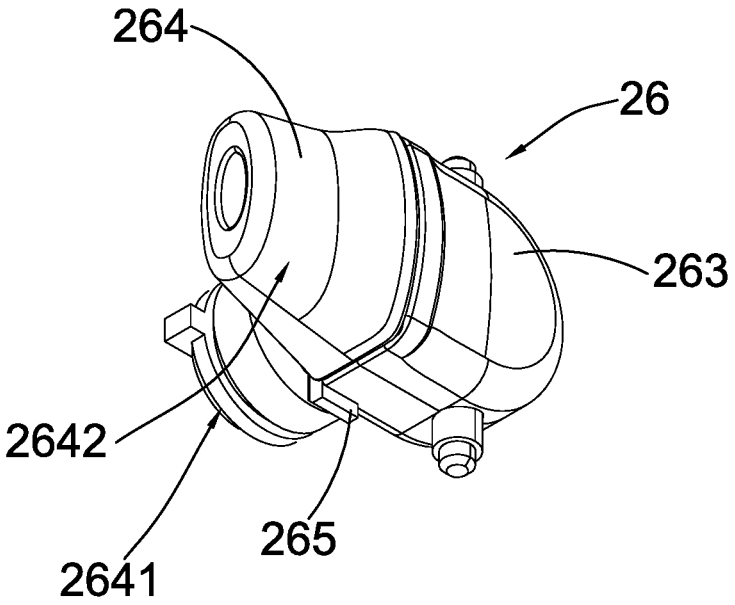
FIG. 6 is a perspective view of the mouth piece of the lid of the beverage container according to the preferred embodiment of the present invention.
Figure 7:
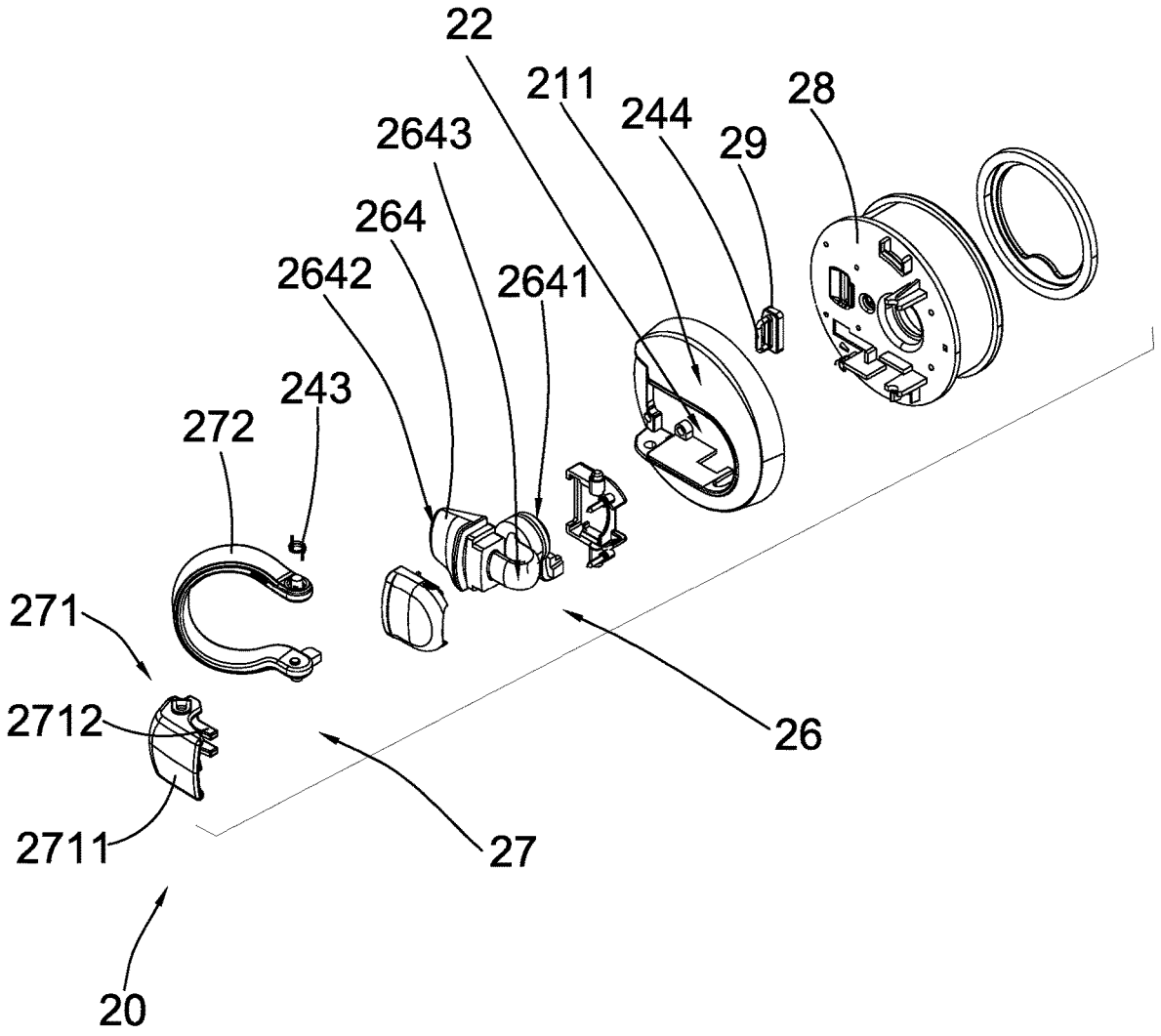
FIG. 7 is an exploded perspective view of a lid body of the lid of the beverage container according to the preferred embodiment of the present invention.

As illustrated in FIG. 2, FIG. 6 and FIG. 7 of the drawings, the suction member 264 may have a base retention portion 2641, a sucking portion 2642 and a connecting portion 2643 extended between the base retention portion 2641 and the sucking portion 2642. The base retention portion 2641 may be connected to the lower tubular portion 212 of the lid body 21 at the passage opening 2124. The sucking portion 2642 may be connected to a top end 2631 of the mouth piece body 263. The connecting portion 2643 may partially penetrate through the mouth piece body 263 for connecting the base retention portion 2641 and the sucking portion 2642.

As stated above, the suction member 264 may be made of elastic material so that the connecting portion 2643 may be retained in a predetermined shape due to material strength. In other words, the connecting portion 2643 may be configured such that the connecting portion 2643 may be forcibly folded toward the receiving slot 22 (see FIG. 6 of the drawings), and when this folding force is released or removed, the connecting portion 2643 may return to its original shape due to inherent material elasticity (see FIG. 2 of the drawings).

In this preferred embodiment of the present invention, this retention force may actually drive the mouth piece body 263 to pivotally move from within the receiving slot 22 (when the mouth piece is in the locked position) to extend upwardly from the receiving slot 22 (when the mouth piece is in the extended position).

The biasing member 265 may extend from the mouth piece body 263 along a transverse direction thereof. The biasing member 265 may be positioned corresponding to the locking latch 25 so that the biasing member 265 may engage with the locking latch 25 when the mouth piece 26 is in the locked position.

Figure 9:
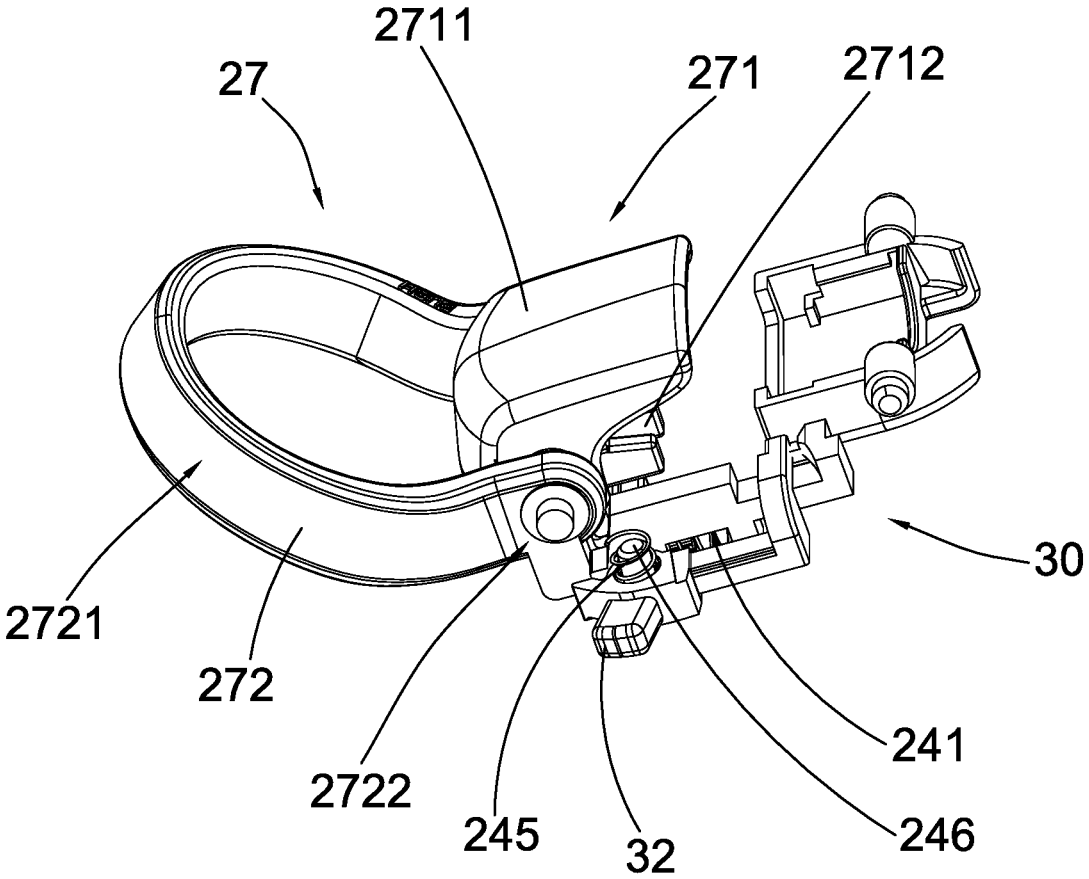
FIG. 9 is a schematic diagram of a locking latch and an actuating handle of the lid of the beverage container according to the preferred embodiment of the present invention.
Figure 10B:
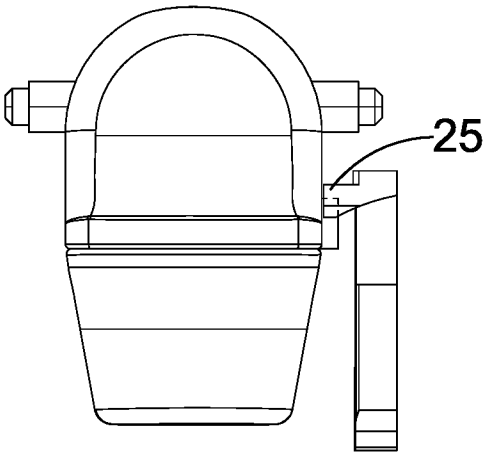
FIG. 10A and FIG. 10B illustrate the interaction between a locking latch and a locking member of the handle actuation arrangement of the lid of the beverage container according to the preferred embodiment of the present invention.
Figure 10A:
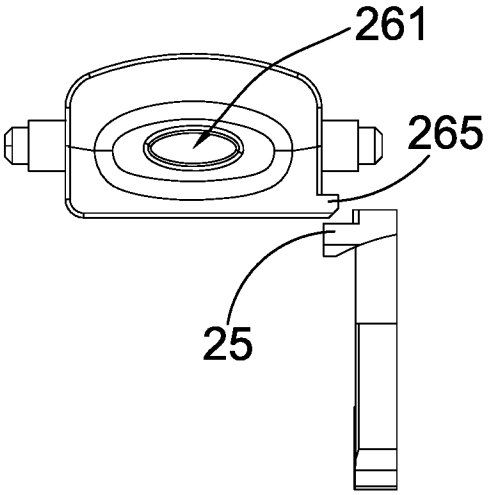

On the other hand, the actuating handle 27 may be mounted in the receiving slot 22 at a position opposite to the mouth piece 26. The handle member 272 may be pivotally mounted on the first sidewall 223 and the second sidewall 224 of the receiving slot 22 and may extend out of the lid body 221 through the opened end portion 222 for allowing a user to grab thereon. As shown in FIG. 8A, FIG. 8B, and FIG. 9 of the drawings, the handle to member 272 may have a grabbing portion 2721 and a connecting portion 2722 pivotally connected to the first sidewall 223 and the second sidewall 224 of the receiving slot 22. The grabbing portion 2721 may extend out of the lid body 21 from the connecting portion 2722. The grabbing portion 2721 may be designed to have an opened loop structure for allowing a user of the present invention to grab thereon. In this preferred embodiment, the connecting portion 2722 may be configured as two connecting legs pivotally connected to the first sidewall 223 and the second sidewall 224 respectively. The handle actuation arrangement 24 may further comprise a second resilient element 243 mounted between one of the connecting legs and the first sidewall 223 so as to exert an urging force to the connecting portion 2722. In this preferred embodiment, the second resilient element 243 may be configured as a spring such as a coil spring, as shown in FIG. 7 of the drawings.

As shown in FIG. 7 and FIG. 8 of the drawings, the engaging member 271 may be pivotally mounted to the connecting portion 2722 so that the engaging member 271 may be pivotally moved with respect to the connecting portion 2722. Specifically, the engaging member 271 may comprise a protection flap 2711 and a plurality of (but at least one) pusher members 2712 extended from the protection flap 2711 to selectively push the mouth piece 26 to move from the locked position to the extended position. The protection flap 2711 may be provided between the connecting portion 2722 and may be pivotally moved to partially cover the receiving slot 22.

On the other hand, the pusher members 2712 may downwardly extend from the protection flap 2711 to receive in the receiving slot 22. The protection flap 2711 and the pusher members 2712 may be pivotally moved in a synchronized manner. The handle actuation arrangement 24 may further comprise third resilient element 244 supported by the supporting platform 28 for normally exerting a biasing force against the engaging member 271.

Figure 3:
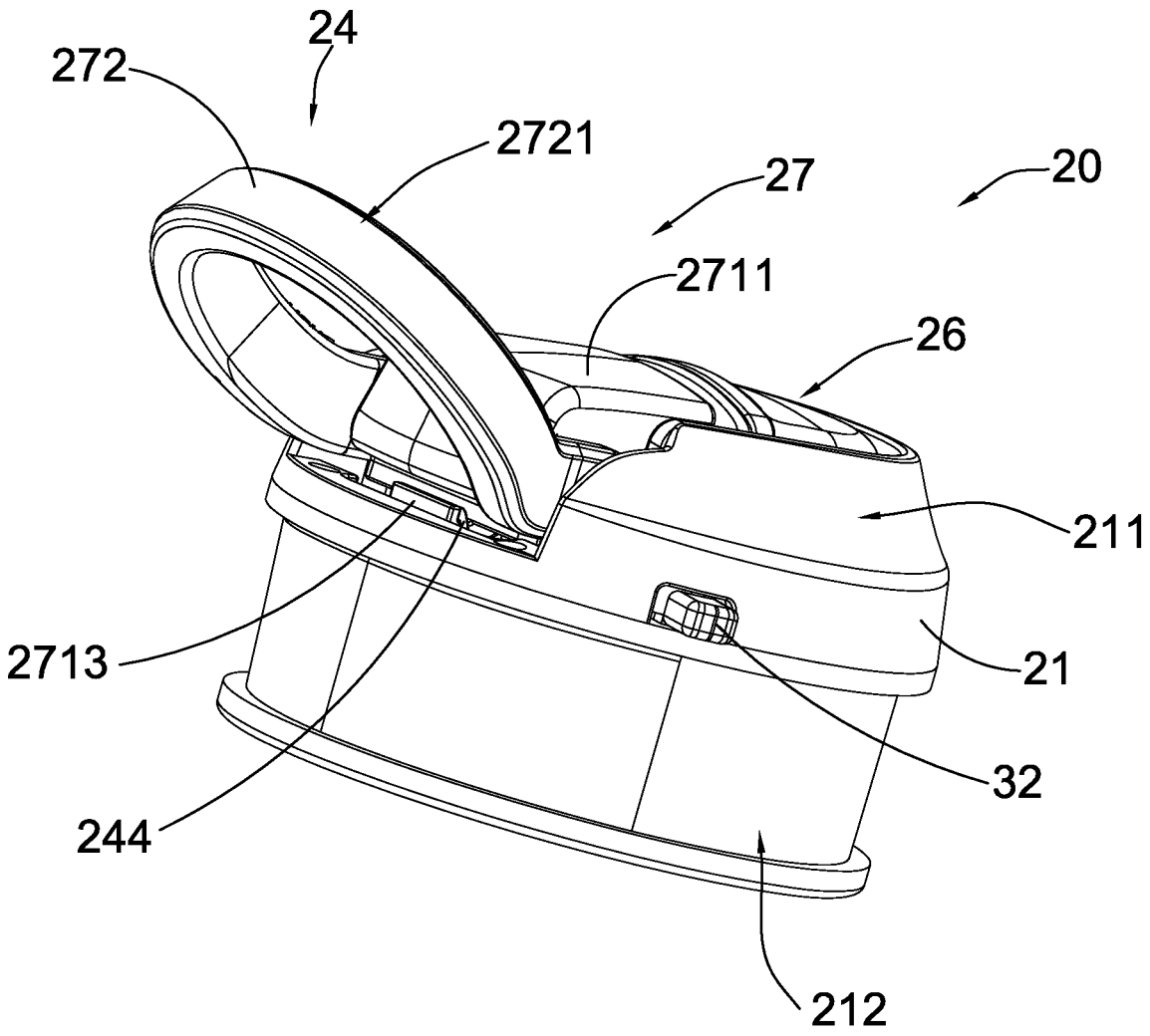
FIG. 3 is a perspective view of the lid of the beverage container according to the above preferred embodiment of the present invention, illustrating that the mouth piece is in a locked position.
Figure 5:
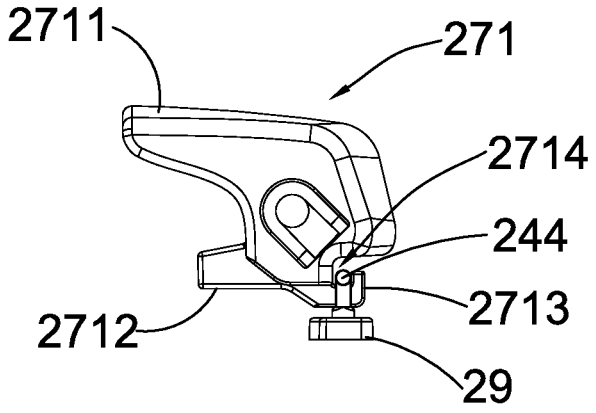
FIG. 5 is a side schematic view of an engaging member of the lid of the beverage container according to the preferred embodiment of the present invention.

Referring to FIG. 3 and FIG. 5 of the drawings, the engaging member 271 may further comprise a mounting hook 2713 downwardly extended from the protection flap 2711 and define a retraction groove 2714, wherein the third resilient element 244 is arranged to partially receive in the retraction groove 2714 so as to normally exert a pivotal driving force against the engaging member 271. In this preferred embodiment, the third resilient element 244 may be configured as a silicon rubber band which is an elongated silicon rubber member affixed on a stationary anchor 29 also provided on the supporting platform 28. The stationary anchor 29 may also be configured from or made of rubber material such as silicon rubber. The third resilient element 244 may possesses a predetermined elasticity and may have two end portions mounted on the stationary anchor 29 and the retraction groove 2714 respectively. When the engaging member 271 is pivotally driven to move in a direction toward the receiving slot 22, the third resilient element 244 may be slightly stretched so that releasing the pivotal driving force may cause the third resilient element 244 to return to its original shape or position due to the elastic nature of the third resilient element 244, and this may pivotally drive the engaging member 271 back to its original position as well.

It is worth mentioning that the pivotal movement of the handle member 272 may be limited by a bottom wall 226 of the receiving slot 22 so that the handle member 272 may be pivotally and outwardly moved (and in clockwise direction illustrated in FIG. 1 of the drawings) until it hits the bottom wall 226 of the receiving slot 22.

The handle actuation arrangement 24 may further comprise a locking mechanism 30 provided in the lid body 21 for selectively preventing or locking the mouth piece 26 from moving into the extended position. The locking mechanism 30 may comprise a blocking member 31 movably mounted in the lid body 21 in such a manner that the blocking member 31 may be moved to block a pivotal movement of the mouth piece body 263 so as to prevent the mouth piece 26 as a whole to move from the locked position to the extended position. The locking mechanism 30 may further comprise an actuation button 32 mounted on the lid body and operatively connected to the blocking member 31 so as to selectively drive the blocking member 31 to block or unblock the movement of the mouth piece 26. A user may be able to block or unblock the movement of the mouth piece 26 by operating on the actuation button 32.

As shown in FIG. 9 of the drawings, the locking mechanism 30 may further comprise a fourth resilient element 245 mounted in the lid body 21, and a securing rod 246 provided in the lid body 21. The fourth resilient element 245 and the securing rod 246 may be coupled to the actuation button 32 so that when the actuation button 32 moves with respect to the lid body 21, the fourth resilient element 245 may bias against the actuation button 32 and the blocking member 31 for stabilizing a movement of the actuation button 32. As such, user who actuates the actuation button 32 may feel enhanced structural stability or integrity of the locking mechanism 30 because unwanted relative movement between the actuation button 32 and the lid body 21 may be minimized or prevented.

The operation of the present invention is as follows: as described above, the mouth piece 26 may be selectively and pivotally moved between the locked position and the extended position. When the mouth piece 26 is manually moved from the extended position to the locked position, the biasing member 265 may be pivotally moved to slightly push the locking latch 25 sidewardly from its original blocking position along the first sidewall 223 until the biasing member 265 passes through and is positioned underneath the locking latch 25. At that time, the locking latch 25 may return to its original blocking position due to the urging force exerted by the first resilient element 241. At this point, the locking latch 25 may be positioned above the biasing member 265 so as to prevent the mouth piece body 263 from pivotally moving to the extended position.

When the mouth piece 26 is pivotally moved from the extended position to the locked position, the mouth piece body 261 may also be driven to bias against the pusher members 2712 of the engaging member 271 so as to drive the actuating handle 27 to pivotally move in a direction toward the receiving slot 22. When this happens, the protection flap 2711 may be arranged to overlap on the mouth piece body 261 and the sucking portion 2642 of the mouth piece 26 so as to physically protect the mouth piece body 261 and the sucking portion 2642 from dirt, dusts, etc. The mouth piece 26 is now in the locked position. Note that the connecting portion 2643 of the suction member 264 may now be folded.

When a user would like to drink the beverage in the container cavity 11, he may need to pivotally move the handle member 272 in the direction toward the receiving slot 22 (preferably in a clockwise direction) and this manual actuation of the handle member 272 may drive the pusher members 2712 to pivotally push the mouth piece body 261 of the mouth piece 26. This pivotal force may overcome the resilient force exerted by the first resilient element 241 so that the biasing member 265 may again push the locking latch 25 sidewardly. Once the blocking force of the locking latch 25 is released, the inherent elastic nature of the connecting portion 2643 may continue driving the mouth piece body 261 to pivotally move in a direction away from the receiving slot 22 until the biasing member 265 passes through the locking latch 25 and is positioned above the locking latch 25 again. The locking latch 25 may again return to the original blocking position when the biasing member 265 passes through the locking latch 25.

The mouth piece 26 may be pivotally moved from the locked position to the extended position until the mouth piece body 261 hits the front wall 225 of the receiving slot 22 and the mouth piece 26 is moved from the locked position to the extended position. A user may be able to drink the liquid contained in the container cavity 11 through the sucking portion 2642. When the manual actuation force is released, the actuating handle 27 may return to its original position due to the inherent elastic nature of the third resilient element 244.

From the forgoing descriptions, one skilled in the art may appreciate that a user may be able to carry the beverage container of the present invention by grabbing on the grabbing portion 2721 of the actuating handle 27. When he or she would like to drink the liquid stored in the container cavity 11, he or she may need only to actuate the actuating handle 27 for driving the mouth piece 26 to move from the locked position to the extended position in the manner described above. After drinking, the user may simply need to manually (probably by one of his hands or by his chin) and pivotally move the mouth piece 26 back to the locked position. A pivotal movement of the mouth piece 26 may pivotally drive the actuating handle 27 to move for receiving in the receiving slot 22. The present invention thus provides an extremely convenient way of moving the mouth piece 26 between the locked position and the extended position.

The present invention, while illustrated and described in terms of a preferred embodiment and several alternatives, is not limited to the particular description contained in this specification. Additional alternative or equivalent components could also be used to practice the present invention.

What is claimed is:

1. A beverage container, comprising:

a container body having a container cavity; and a lid, which comprises a lid body detachably attached on said container body to selectively enclose said container cavity, said lid body having a receiving slot and an access opening communicating said container cavity and said receiving slot; and a handle actuation arrangement, which comprises:

a locking latch movably mounted in said receiving slot;

a mouth piece having a liquid discharge opening and a drinking channel communicating between said access opening and said liquid discharge opening, said mouth piece being pivotally connected to said lid body in said receiving slot to move in a locked position and an extended position, wherein in said locked position, said mouth piece is pivotally moved to be received in said receiving slot and engaged with said locking latch, wherein in said extended position, said mouth piece is pivotally moved to extend from said receiving slot; and an actuating handle, which comprises:

an engaging member pivotally received in said receiving slot to engage with said mouth piece; and a handle member extended from said engaging member in such a manner that when said handle member is pivotally moved with respect to said lid body, said engaging member is also driven to pivotally move to drive said mouth piece to disengage from said locking latch so as to allow said mouth piece to move from said locked position to said extended position.

2. The beverage container, as recited in claim 1, wherein said lid further comprise a supporting platform provided in said lid body to divide said lid body into an upper enclosure portion and a lower tubular portion, said lower tubular portion forming a tubular structure and having a circumferential wall which defines a central cavity as a space surrounded by said circumferential wall, said drinking channel of said mouth piece communicating with said central cavity of said lid body, said upper enclosure portion upwardly extending from said lower tubular portion, wherein said receiving slot is indently provided on said upper enclosure portion.

3. The beverage container, as recited in claim 2, wherein said receiving slot has a closed end portion and an opened end portion opposite to said closed end portion, wherein said mouth piece is operatively provided at said closed end portion of said receiving slot, while said actuating handle is provided at said opened end portion, said receiving slot being defined by a first sidewall, a second sidewall, a front wall extending between said first sidewall and said second sidewall, and a bottom wall extending from said first sidewall, said second sidewall and said front wall.

4. The beverage container, as recited in claim 3, wherein said locking latch is movably mounted on said first sidewall in such a manner that said locking latch is extended in said receiving slot, said handle actuation arrangement further comprising a first resilient element mounted in said lid body and is arranged to exert a biasing force against said locking latch so as to normally retain said locking latch at a predetermined position in said receiving slot for blocking a movement of said mouth piece.

5. The beverage container, as recited in claim 4, wherein said mouth piece further comprises a mouth piece body, a suction member coupled to said mouth piece body, and a biasing member extended from said mouth piece body to selectively engage with said locking latch, said mouth piece body pivotally mounting to said first sidewall and said second sidewall so as to allow said mouth piece to move between said locked position and said extended position.

6. The beverage container, as recited in claim 5, wherein said suction member is made of elastic material and has a base retention portion, a sucking portion and a connecting portion extended between said base retention portion and said sucking portion, said base retention portion connecting to said lower tubular portion of said lid body, said sucking portion connecting to said mouth piece body, said connecting portion partially penetrating through said mouth piece body for connecting said base retention portion and said sucking portion, said suction member being made of elastic material so that said connecting portion is to be retained in a predetermined shape due to material strength.

7. The beverage container, as recited in claim 6, wherein said biasing member is extended from said mouth piece body along a transverse direction thereof, said biasing member being positioned corresponding to said locking latch so that said biasing member is arranged to be blocked by said locking latch when said mouth piece is in said locked position.

8. The beverage container, as recited in claim 6, wherein said actuating handle is mounted in said receiving slot at a position opposite to said mouth piece, said handle member being pivotally mounted on said first sidewall and said second sidewall of said receiving slot and extending out of said lid body through said opened end portion, said handle member having a grabbing portion and a connecting portion pivotally connected to said first sidewall and said second sidewall of said receiving slot, said handle actuation arrangement further comprising a second resilient element mounted between said connecting portion to said first sidewall.

9. The beverage container, as recited in claim 8, wherein said engaging member is pivotally mounted to said connecting portion so that said engaging member is capable of pivotally moving with respect to said connecting portion, said engaging member comprising a protection flap and at least one pusher member extended from said protection flap to selectively push said mouth piece to move from said locked position to said extended position, said protection flap being provided between said connecting portion and arranged to pivotal move to partially cover said receiving slot.

10. The beverage container, as recited in claim 9, wherein said pusher member downwardly extends from said protection flap to receive in said receiving slot, said protection flap and said pusher member are pivotally moved in a synchronized manner, said handle actuation arrangement further comprising third resilient element supported by said supporting platform for normally exerting a biasing force against said engaging member.

11. The beverage container, as recited in claim 10, wherein said engaging member further comprises a mounting hook downwardly extended from said protection flap and defining a retraction groove, wherein said third resilient element is arranged to partially receive in said retraction groove so as to normally exert a pivotal driving force against said engaging member, said lid further comprising a stationary anchor provided on said supporting platform, said third resilient element being configured as a silicon rubber band mounted between said stationary anchor and said retraction groove, so that when said engaging member is pivotally driven to move in a direction toward said receiving slot, said third resilient element is slightly stretched and releasing said pivotal driving force is arranged to cause said third resilient element to return to original shape and at the same time pivotally drive said engaging member back to original position.

12. A lid for a beverage container comprising a container body having a container cavity, said lid comprising:

a lid body arranged for detachably attaching on said container body to selectively enclose said container cavity, said lid body having a receiving slot and an access opening communicating said container cavity and said receiving slot; and a handle actuation arrangement, which comprises:

a locking latch movably mounted in said receiving slot;

a mouth piece having a liquid discharge opening and a drinking channel communicating between said access opening and said liquid discharge opening, said mouth piece being pivotally connected to said lid body in said receiving slot to move in a locked position and an extended position, wherein in said locked position, said mouth piece is pivotally moved to be received in said receiving slot and engaged with said locking latch, wherein in said extended position, said mouth piece is pivotally moved to extend from said receiving slot; and an actuating handle, which comprises:

an engaging member pivotally received in said receiving slot to engage with said mouth piece; and a handle member extended from said engaging member in such a manner that when said handle member is pivotally moved with respect to said lid body, said engaging member is also driven to pivotally move to drive said mouth piece to disengage from said locking latch so as to allow said mouth piece to move from said locked position to said extended position.

13. The beverage container, as recited in claim 12, wherein said lid further comprise a supporting platform provided in said lid body to divide said lid body into an upper enclosure portion and a lower tubular portion, said lower tubular portion forming a tubular structure and having a circumferential wall which defines a central cavity as a space surrounded by said circumferential wall, said drinking channel of said mouth piece communicating with said central cavity of said lid body, said upper enclosure portion upwardly extending from said lower tubular portion, wherein said receiving slot is indently provided on said upper enclosure portion.

14. The beverage container, as recited in claim 13, wherein said receiving slot has a closed end portion and an opened end portion opposite to said closed end portion, wherein said mouth piece is operatively provided at said closed end portion of said receiving slot, while said actuating handle is provided at said opened end portion, said receiving slot being defined by a first sidewall, a second sidewall, a front wall extending between said first sidewall and said second sidewall, and a bottom wall extending from said first sidewall, said second sidewall and said front wall.

15. The beverage container, as recited in claim 14, wherein said locking latch is movably mounted on said first sidewall in such a manner that said locking latch is extended in said receiving slot, said handle actuation arrangement further comprising a first resilient element mounted in said lid body and is arranged to exert a biasing force against said locking latch so as to normally retain said locking latch at a predetermined position in said receiving slot for blocking a movement of said mouth piece.

16. The beverage container, as recited in claim 15, wherein said mouth piece further comprises a mouth piece body, a suction member coupled to said mouth piece body, and a biasing member extended from said mouth piece body to selectively engage with said locking latch, said mouth piece body pivotally mounting to said first sidewall and said second sidewall so as to allow said mouth piece to move between said locked position and said extended position.

17. The beverage container, as recited in claim 16, wherein said suction member is made of elastic material and has a base retention portion, a sucking portion and a connecting portion extended between said base retention portion and said sucking portion, said base retention portion connecting to said lower tubular portion of said lid body, said sucking portion connecting to said mouth piece body, said connecting portion partially penetrating through said mouth piece body for connecting said base retention portion and said sucking portion, said suction member being made of elastic material so that said connecting portion is to be retained in a predetermined shape due to material strength.

18. The beverage container, as recited in claim 17, wherein said biasing member is extended from said mouth piece body along a transverse direction thereof, said biasing member being positioned corresponding to said locking latch so that said biasing member is arranged to be blocked by said locking latch when said mouth piece is in said locked position.

19. The beverage container, as recited in claim 18, wherein said actuating handle is mounted in said receiving slot at a position opposite to said mouth piece, said handle member being pivotally mounted on said first sidewall and said second sidewall of said receiving slot and extending out of said lid body through said opened end portion, said handle member having a grabbing portion and a connecting portion pivotally connected to said first sidewall and said second sidewall of said receiving slot, said handle actuation arrangement further comprising a second resilient element mounted between said connecting portion and said first sidewall.

20. The beverage container, as recited in claim 19, wherein said engaging member is pivotally mounted to said connecting portion so that said engaging member is capable of pivotally moving with respect to said connecting portion, said engaging member comprising a protection flap and at least one pusher member extended from said protection flap to selectively push said mouth piece to move from said locked position to said extended position, said protection flap being provided between said connecting portion and arranged to pivotal move to partially cover said receiving slot.

21. The beverage container, as recited in claim 20, wherein said pusher member downwardly extends from said protection flap to receive in said receiving slot, said protection flap and said pusher member are pivotally moved in a synchronized manner, said handle actuation arrangement further comprising third resilient element supported by said supporting platform for normally exerting a biasing force against said engaging member.

22. The beverage container, as recited in claim 21, wherein said engaging member further comprises a mounting hook downwardly extended from said protection flap and defining a retraction groove, wherein said third resilient element is arranged to partially receive in said retraction groove so as to normally exert a pivotal driving force against said engaging member, said lid further comprising a stationary anchor provided on said supporting platform, said third resilient element being configured as a silicon rubber band mounted between said stationary anchor and said retraction groove, so that when said engaging member is pivotally driven to move in a direction toward said receiving slot, said third resilient element is slightly stretched and releasing said pivotal driving force is arranged to cause said third resilient element to return to original shape and at the same time pivotally drive said engaging member back to original position.

* * * * *